US009709935B2

(12) United States Patent
Mitani et al.

(10) Patent No.: US 9,709,935 B2
(45) Date of Patent: Jul. 18, 2017

(54) FIXING APPARATUS

(71) Applicant: CANON KABUSHIKI KAISHA, Tokyo (JP)

(72) Inventors: Takanori Mitani, Meridian, ID (US); Akimichi Suzuki, Yokohama (JP); Satoshi Nishida, Numazu (JP); Isamu Takeda, Machida (JP); Kazuhiro Doda, Yokohama (JP); Keisuke Samejima, Suntou-gun (JP); Hiroshi Yadoiwa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/164,763

(22) Filed: May 25, 2016

(65) Prior Publication Data

US 2016/0349680 A1 Dec. 1, 2016

(30) Foreign Application Priority Data

May 29, 2015 (JP) ..... 2015-110381

(51) Int. Cl.
*G03G 15/20* (2006.01)
*G03G 15/00* (2006.01)

(52) U.S. Cl.
CPC ..... *G03G 15/2039* (2013.01); *G03G 15/55* (2013.01); *G03G 15/80* (2013.01); *G03G 2215/2019* (2013.01); *G03G 2215/2035* (2013.01)

(58) Field of Classification Search
CPC ..... G03G 15/2039; G03G 15/55
USPC ..... 399/33
See application file for complete search history.

(56) References Cited

U.S. PATENT DOCUMENTS

| | | | | |
|---|---|---|---|---|
| 7,778,557 | B2 * | 8/2010 | Mashiba | G03G 15/2039 399/33 |
| 2009/0257766 | A1 * | 10/2009 | Takada | G03G 15/2039 399/67 |
| 2010/0054785 | A1 * | 3/2010 | Ogiso | G03G 15/2039 399/69 |
| 2011/0318040 | A1 * | 12/2011 | Kanno | G03G 15/2039 399/69 |
| 2012/0093534 | A1 * | 4/2012 | Waida | G03G 15/2046 399/69 |

FOREIGN PATENT DOCUMENTS

| | | | |
|---|---|---|---|
| JP | 2004-258536 | A | 9/2004 |
| JP | 2008-304799 | A | 12/2008 |
| JP | 2009-15107 | A | 1/2009 |
| JP | 2012177790 | A * | 9/2012 |

* cited by examiner

*Primary Examiner* — Susan Lee
(74) *Attorney, Agent, or Firm* — Canon U.S.A. Inc., IP Division

(57) ABSTRACT

Provided is a fixing apparatus for fixing a toner image on a recording material while conveying the recording material on which the toner image has been formed at a nip portion that includes a roller, a heating unit configured to heat the roller from outside the roller, the heating unit receiving power supplied from a power supply, a backup unit forming the nip portion with the roller, and a power shutdown member configured to operate in response to an abnormal temperature of the backup unit and shut down power supply to the heating unit.

10 Claims, 9 Drawing Sheets

FIXING APPARATUS

BACKGROUND OF THE INVENTION

Field of the Invention

The present invention relates to a fixing apparatus used in an electrophotographic image forming apparatus, such as a copier and a printer.

Description of the Related Art

An external heating fixing apparatus is proposed as a fixing apparatus used in an electrophotographic copier or printer. An external heating fixing apparatus usually includes a roller, a heating unit for heating the roller from outside, and a backup unit which forms a nip portion with the roller (see Japanese Patent Laid-Open No. 2004-258536).

The fixing apparatus is provided with a safeguard against loss of control of the heater due to a failure of a power control circuit, such as a CPU runaway or a short-circuit of a triac which controls the power supplied to the heater provided in the heating unit. The safeguard may be a power shutdown member, such as a thermoswitch and a thermal fuse, and a means for detecting an abnormal temperature by a thermistor and the like and shutting down the power supply to the heater. In the related art, the thermoswitch, the thermal fuse, the thermistor, and the like are provided near the heater which is the heat source (i.e., on the heating unit side) to facilitate sensitive reaction to an abnormal temperature rise of the apparatus.

In the external heating fixing apparatus, however, a backup unit is provided distant from the heating unit. Therefore, if an apparatus runaway occurs and an abnormal temperature rise is caused, it can be difficult to keep the temperature of the backup unit not to exceed a heatproof temperature using a safeguard provided in the heating unit.

SUMMARY OF THE INVENTION

According to an aspect of the present invention, a fixing apparatus for fixing a toner image on a recording material while conveying the recording material on which the toner image has been formed at a nip portion: a roller; a heating unit configured to heat the roller from outside the roller, the heating unit receiving power supplied from a power supply; a backup unit forming the nip portion with the roller; and a power shutdown member configured to operate in response to an abnormal temperature of the backup unit and shut down power supply to the heating unit.

According to an aspect of the present invention, a fixing apparatus for fixing a toner image on a recording material while conveying the recording material on which the toner image has been formed at a nip portion: a roller; a heating unit configured to heat the roller from outside the roller, the heating unit receiving power supplied from a power supply; a backup unit forming the nip portion with the roller; a first power shutdown member configured to operate in response to an abnormal temperature of the heating unit and shut down power supply to the heating unit; and a second power shutdown member configured to operate in response to an abnormal temperature of the backup unit and shut down power supply to the heating unit.

Further features of the present invention will become apparent from the following description of exemplary embodiments with reference to the attached drawings.

DESCRIPTION OF THE EMBODIMENTS

First Embodiment

(1) Exemplary Image Forming Apparatus

Figure 2:
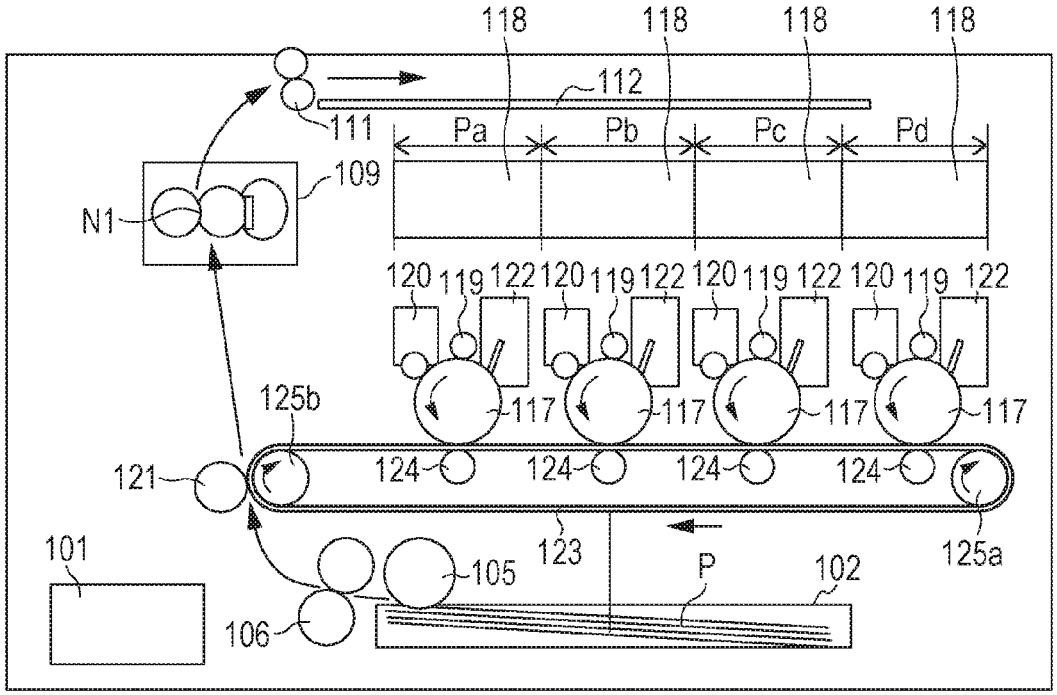
FIG. 2 is a transverse cross-sectional view schematically illustrating a structure of an image forming apparatus.

FIG. 2 is a schematic cross-sectional view of an image forming apparatus on which a fixing apparatus according to the present embodiment is mounted. The image forming apparatus is an electrophotographic laser beam printer.

The image forming apparatus of the present embodiment is an in-line apparatus in which first to fourth image forming units Pa, Pb, Pc and Pd are arranged in a predetermined direction. The image forming units form toner images using cyan, magenta, yellow, and black toner as a developer, respectively. Each of the image forming units Pa, Pb, Pc and Pd has an electrophotographic photoconductor (hereafter, "photoconductive drum") 117 as an image bearing member.

In each of the image forming units Pa to Pd, a drum charging unit 119 as a charging member, and a scanning exposure device 107 as an exposure unit are provided near an outer peripheral surface of the photoconductive drum 117. A developing unit 120 as a developing means and a drum cleaner 122 are provided near the outer peripheral surface of the photoconductive drum 117. An intermediate transfer belt 123 as an intermediate image bearing member is provided to extend along the photoconductive drums 117. The intermediate transfer belt 123 is stretched between a driving roller 125*a* and a secondary transfer facing roller 125*b*.

On an inner peripheral surface side of the intermediate transfer belt 123, primary transfer rollers 124 are provided to face the photoconductive drums 117 via intermediate transfer belt 123. On the outer peripheral surface side of the intermediate transfer belt 123, a secondary transfer roller 121 is provided to face the secondary transfer facing roller 125*b* via the intermediate transfer belt 123.

In the image forming apparatus of the present embodiment, a control unit 101 executes a predetermined image formation sequence at a print command output from an external device (not illustrated), such as a host computer, a terminal on a network, and an external scanner. The control unit 101 is constituted by memory, such as a CPU, ROM, and RAM. The memory stores an image formation sequence, various programs required for image formation, and the like.

An image formation operation of the image forming apparatus of the present embodiment is described with reference to FIG. 2. The control unit 101 drives sequentially the image forming units Pa, Pb, and Pc and Pd in accordance with the image formation sequence executed at the print command. First, each of the photoconductive drums 117 is rotated in the arrow direction at a predetermined peripheral speed (a process speed) and the intermediate transfer belt 123 is rotated in the arrow direction by the driving roller 125*a* at a peripheral speed corresponding to a rotary peripheral speed of each photoconductive drum 117.

In the image forming unit Pa for cyan, a surface of the photoconductive drum 117 is uniformly charged to a predetermined polarity and a potential by the drum charging unit 119. Next, the scanning exposure device 107 scan-exposes the charged surface of the photoconductive drum 117 with laser light in accordance with image information output from the external device. Then an electrostatic latent image in accordance with the image information is formed in the charged surface of the photoconductive drum 117. The electrostatic latent image is developed with the cyan toner by the developing unit 120. The cyan toner image is formed on the surface of the photoconductive drum 117.

The same charging, exposure, and developing processes are performed in the image forming unit Pb for magenta, the image forming unit Pc for yellow, and the image forming unit Pd for black. The toner image of each color formed on the surface of each photoconductive drum 117 is transferred sequentially in an overlapped manner on a surface of the intermediate transfer belt 123 in a primary transfer nip portion formed by the surface of the photoconductive drum 117 and a surface of the intermediate transfer belt 123 in contact with each other. In this manner, a full color toner image is born on the surface of the intermediate transfer belt 123.

After the toner image is transferred from the photoconductive drum 117, transfer residual toner remaining on the surface of the photoconductive drum 117 is removed by the drum cleaner 122 and the surface of the photoconductive drum 117 is used for subsequent image formation.

The recording material P, such as recording paper, is fed out one at a time by a feed roller 105 from a sheet cassette 102, and is conveyed by a resist roller 106. The recording material P is conveyed by the resist roller 106 to a secondary transfer nip portion formed by the surface of the intermediate transfer belt 123 and a surface of the secondary transfer roller 121 in contact with each other.

In the conveyance process, the toner image on the surface of the intermediate transfer belt 123 is transferred to the recording material P in the secondary transfer nip portion. Then, an unfixed full color toner image is born on the recording material P.

The recording material P on which the full color toner image is born is introduced into a fixing nip portion N1 of a later-described fixing apparatus 109. The toner image is heated and pressed in the fixing nip portion N1 while conveying the recording material P, whereby the toner image on the recording material P is fixed to the recording material P.

The recording material P conveyed out of the fixing nip portion N1 is discharged on a discharge tray 112 by an ejection roller 111.

(2) Fixing Apparatus

In the following description, regarding the fixing apparatus and the member which constitutes the fixing apparatus, the longitudinal direction perpendicularly crosses a recording material conveyance direction on the surface of the recording material. The width direction is the direction parallel to the recording material conveyance direction. The length is the dimension in the longitudinal direction. The width is the dimension in the width direction.

Figure 1A:
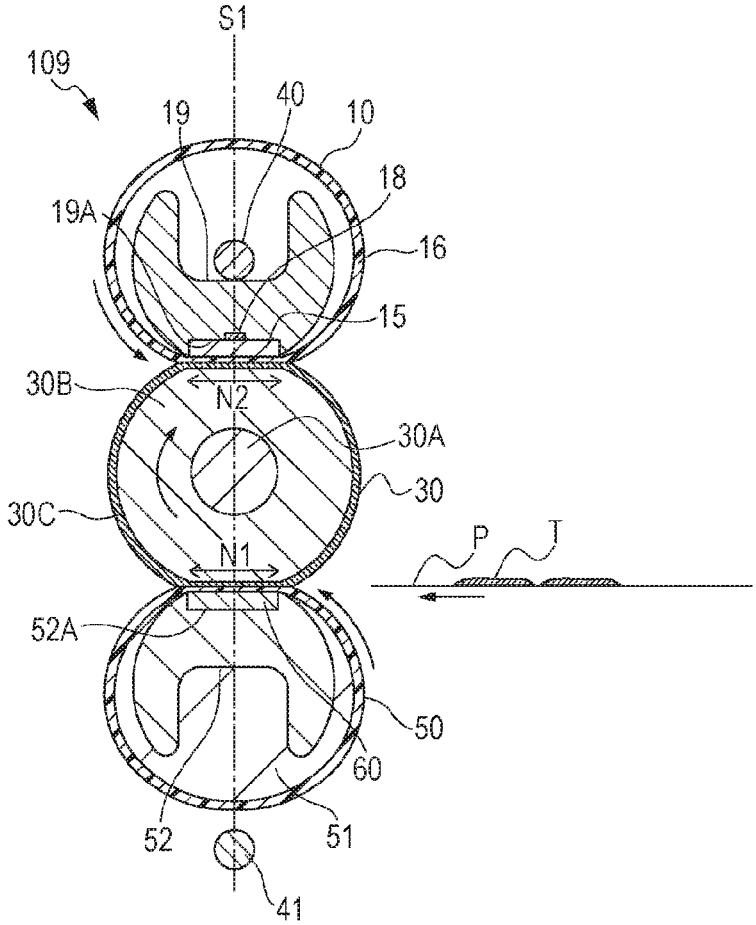
FIG. 1A is a cross-sectional view schematically illustrating a structure of a fixing apparatus in the width direction according to a first embodiment.
Figure 1B:
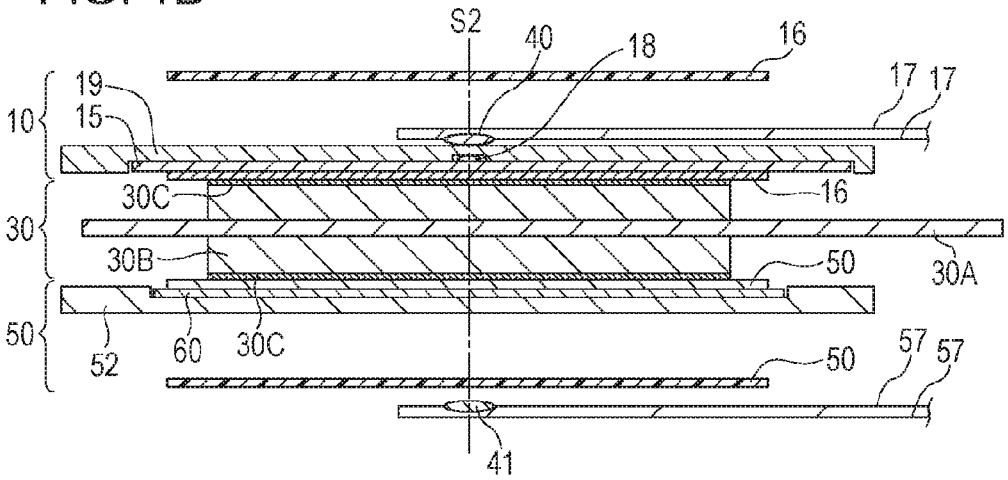
FIG. 1B is a cross-sectional view schematically illustrating a structure of the fixing apparatus in the longitudinal direction according to the first embodiment.
Figure 3:
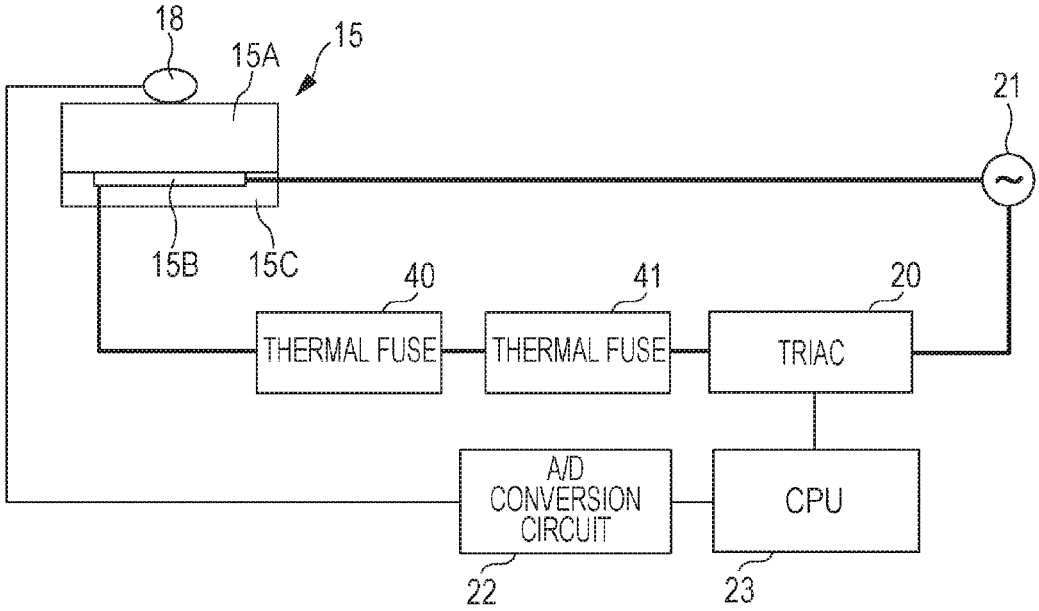
FIG. 3 is an explanatory view illustrating a heater and a power control system used in the fixing apparatus according to the first embodiment.

FIG. 1A is a cross-sectional view schematically illustrating a structure of the fixing apparatus in the width direction according to a first embodiment. FIG. 1B is a cross-sectional view schematically illustrating a structure of the fixing apparatus in the longitudinal direction according to the first embodiment. FIG. 1A is a cross-sectional view along a dash-dot line S2 of FIG. 1B, and FIG. 1B is a cross-sectional view along a dash-dot line S1 of FIG. 1A. FIG. 3 is an explanatory view of a ceramic heater 15 and a power application control system. The fixing apparatus 109 is an external heating fixing apparatus.

The fixing apparatus 109 according to the present embodiment is provided with a fixing roller 30, a heating unit 10 as a heating unit, and a pressurizing unit 50 as a backup unit. The fixing roller 30 is elongated in the longitudinal direction.

The fixing roller 30 has a cylindrical shaft-shaped core metal 30A formed by a metallic material, such as iron, SUS, and aluminum. An elastic layer 30B formed mainly by silicone rubber or the like is formed on an outer peripheral surface of the core metal 30A. A releasing layer 30C formed mainly by PTFE, PFA, FEP or the like is formed on an outer peripheral surface of the elastic layer 30B. PTFE is an abbreviation of polytetrafluoroethylene, PFA is an abbreviation of tetrafluoroethylene perfluoroalkyl vinylether copolymer, and FEP is an abbreviation of tetrafluoroethylene hexafluoropropylene copolymer.

In the fixing roller 30, both longitudinal ends of the core metal 30A are rotatably supported by a side plate (not illustrated) of both longitudinal sides of a device frame (not illustrated) via bearings (not illustrated).

The heating unit 10 has a ceramic heater (hereafter, "heater") 15 as a heat source, a cylindrical heating film 16, a heating film guide 19, and a thermal fuse 40 as a second protective element. The heating film guide 19 is formed by a predetermined heat-resistant material to have a substantially recessed cross section. Both longitudinal ends of the heating film guide 19 are supported by the side plate of both longitudinal sides of the device frame. The heater 15 is supported by a groove 19A provided on a flat face of the heating film guide 19 along the longitudinal direction of the heating film guide 19. A heating film 16 is loosely attached from outside to the heating film guide 19 by which the heater 15 is supported. The heater 15, the heating film 16, and the heating film guide 19 are all elongated in the longitudinal direction.

The heater 15 has a thin-plate shaped substrate 15A formed mainly by ceramics, such as alumina and aluminum nitride. A heat generating resistive element 15B made mainly of Ag, palladium, and the like is provided along the longitudinal direction of the substrate 15A on the surface of the substrate 15A on the side of heating film 16. A protective layer 15C made mainly of heat-resistant resin, such as glass, fluororesin, or polyimide, is provided to cover the heat generating resistive element 15B on the surface of the substrate 15A.

The thermal fuse 40 is provided inside the heating unit 10. Specifically, the thermal fuse 40 is drawn into the heating film 16 by a wire 17, and disposed in contact with the heating film guide 19 on the surface of the heating film guide 19 opposite to the side of the heater 15. It is not necessary to dispose the thermal fuse 40 as described in the present embodiment, but may be disposed at any position in the heating unit as long as the thermal fuse 40 is operable during abnormal temperatures described later. The thermal fuse 40 may operate promptly against an abnormal temperature as the thermal fuse 40 is disposed closer to the heater 15. However, since the heat easily flows into the thermal fuse 40 from the heater 15, a temperature rise of the heater 15 may become slower. Therefore, the thermal fuse 40 is desirably separated from the heater 15 in a range in which the thermal fuse 40 may operate against an abnormal temperature.

An operating temperature of the thermal fuse 40 is 275° C. (a second threshold temperature). That is, the thermal fuse 40 keeps inter-electrode electrical connection at both ends in normal use, whereas if the temperature of the thermal fuse 40 rises to 275° C., the inter-electrode electrical connection at both ends of the thermal fuse 40 is shut down physically.

The heating film 16 is formed so that an inner peripheral length thereof is longer than an outer peripheral length of the heating film guide 19 by a predetermined length, and the heating film 16 is loosely attached to the heating film guide 19 from outside with no tension. The heating film 16 employs a two-layer structure in which an outer peripheral surface of an endless belt-shaped polyimide-based base layer is coated with an endless belt-shaped PFA-based surface layer. The base layer of the heating film 16 of the present embodiment is made of polyimide.

The heating unit 10 is disposed in parallel with the fixing roller 30. The both longitudinal ends of the heating film guide 19 are urged by a pressurization spring (not illustrated) in the direction to perpendicularly cross a bus line of the heating film 16 with respect to the fixing roller 30. An outer surface of the protective layer 15C of the heater 15 is pressed against the outer peripheral surface of the fixing roller 30 via the heating film 16. Then, the elastic layer 30B of the fixing roller 30 is elastically deformed at a position corresponding to the outer surface of the protective layer 15C of the heater 15, and a heating pressure contact portion N2 (a pressure contact portion) of a prescribed width is formed by the surface of the fixing roller 30 and an outer peripheral surface of the heating film 16. In this manner, the heater 15 forms a heating pressure contact portion N2 with the fixing roller 30 via the heating film 16. Therefore, the heater 15 also functions as a pressure contact portion forming member.

The pressurizing unit 50 has a cylindrical pressurizing film 51, a pressurizing film guide 52, a nip portion forming member 60, and a thermal fuse 41 as a first protective element. The pressurizing film guide 52 is formed by a predetermined heat-resistant material to have a substantially recessed cross section.

The nip portion forming member 60 is supported by a groove 52A provided on a flat face of the pressurizing film guide 52 along the longitudinal direction of the pressurizing film guide 52.

The thermal fuse 41 is provided outside the pressurizing unit 50 not in contact with the pressurizing unit 50. Specifically, the thermal fuse 41 is drawn in near the pressurizing film 51 by a wire 57, and is disposed not in contact with the outer surface of the pressurizing film 51. Although the thermal fuse 41 and the pressurizing unit 50 do not necessarily have to be disposed in contact with each other, damage to the pressurizing film 51 due to contact with the thermal fuse 41 can be avoided if the thermal fuse 41 and the pressurizing unit 50 are not in contact. Further, if the thermal fuse 41 and the pressurizing film 51 are not in contact, the startup time of the fixing apparatus may be shortened. This is because if the thermal fuse 41 and the pressurizing film 51 are in contact with each other, the thermal fuse 41 takes heat from the pressurizing film 51 during startup, and time until the fixing roller 30 reaches the fixable temperature becomes longer.

An operating temperature of the thermal fuse 41 is 155° C. (a first threshold temperature). That is, the thermal fuse 41 keeps inter-electrode electrical connection at both ends in normal use, whereas if the temperature of the thermal fuse 41 rises to 155° C., inter-electrode electrical connection at both ends of the thermal fuse 41 is shut down physically. Both longitudinal ends of the pressurizing film guide 52 are supported by the side plate of both sides in the longitudinal direction of the device frame. The pressurizing film 51 is attached to the pressurizing film guide 52 from outside. Both of the pressurizing film 51 and the pressurizing film guide 52 are elongated in the longitudinal direction.

The pressurizing film 51 is formed so that an inner peripheral length thereof is longer than an outer peripheral length of the pressurizing film guide 52 by a predetermined length, and the pressurizing film 51 is loosely attached to the pressurizing film guide 52 from outside with no tension. The pressurizing film 51 employs a two-layer structure in which an outside of the base layer of an endless belt-shaped PEKEKK (made by Victrex, glass transition point Tg: 162° C.) which is thermoplastic resin is coated with an endless belt-shaped PFA-based surface layer. The base layer of the pressurizing film 51 is formed mainly by thermoplastic resin, such as polyether ether ketone (PEEK) and polyetherimide (PEI). The pressurizing film 51 is not limited to thermoplastic resin, and may be formed by heat curing resin, such as polyimide (PI), or metal, such as SUS. Although the base layer of the pressurizing film 51 formed mainly by thermoplastic resin is inferior to the heat curing resin in heat resistance, the base layer of the pressurizing film 51 may be manufactured by, for example, extrusion molding, which is a less expensive process.

The pressurizing unit 50 is disposed in substantially parallel with the fixing roller 30. The both end portions in the longitudinal direction of the pressurizing film guide 52 are urged by the pressurization spring (not illustrated) in the direction perpendicularly crossing a bus line of the fixing roller 30. The nip portion forming member 60 of the pressurizing unit 50 is pressed against the outer peripheral surface of the fixing roller 30 via the pressurizing film 51. Then, the elastic layer 30B of the fixing roller 30 is elastically deformed at a position corresponding to the surface of the nip portion forming member 60, and the fixing nip portion N1 of a prescribed width is formed by the surface of the fixing roller 30 and the outer peripheral surface of the pressurizing film 51. In this manner, the nip portion forming member 60 forms the fixing nip portion N1 with the fixing roller 30 via the pressurizing film 51.

Figure 4:
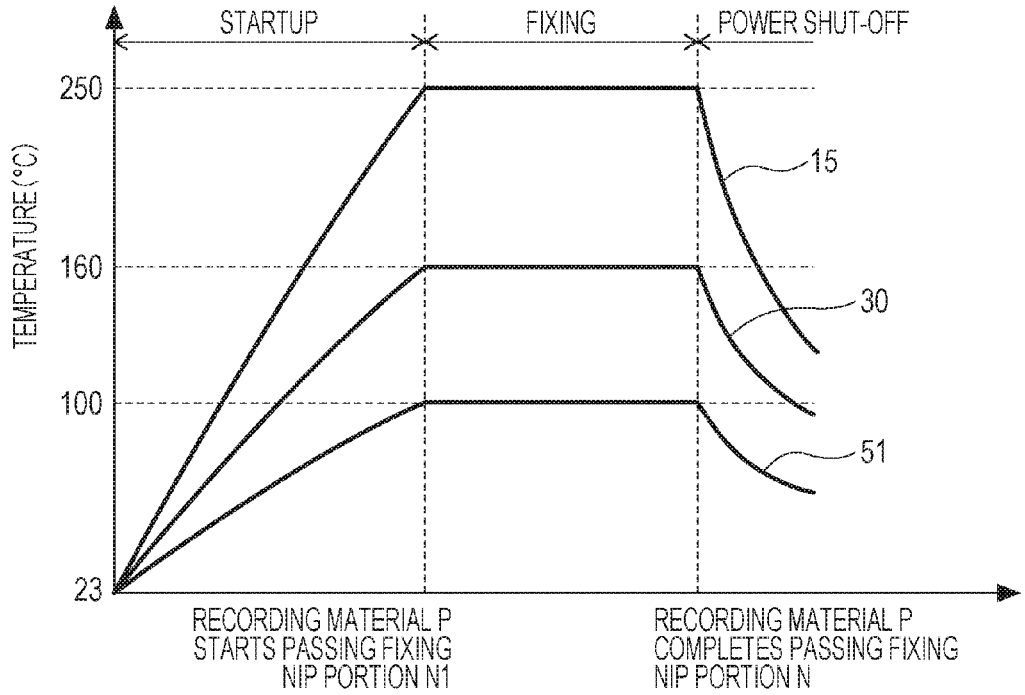
FIG. 4 illustrates temperature transition of the heater, a fixing roller, and a pressurizing film of the fixing apparatus during fixing a recording material P according to the first embodiment.

An operation of the fixing apparatus 109 is described with reference to FIGS. 1 and 4. The control unit 101 drives a driving motor M as a driving source to rotate in accordance with the image formation sequence executed at the print command. The rotation of an output shaft of the driving motor M is transmitted to the core metal 30A of the fixing roller 30 via a predetermined gear train (not illustrated). Then the fixing roller 30 is rotated at a predetermined peripheral speed (a process speed) in the arrow direction. The rotation of the fixing roller 30 is transmitted to the pressurizing film 51 by the frictional force produced between the surface of the fixing roller 30 and the surface of the pressurizing film 51 in the fixing nip portion N1. Therefore, the pressurizing film 51 is driven to rotate in the arrow direction with the fixing roller 30 while the inner peripheral surface of the pressurizing film 51 is sliding against the nip portion forming member 60 of the pressurizing film guide 52. Driving force of the fixing roller 30 is transmitted to the heating film 16 as the frictional force produced between the surface of the fixing roller 30 and the surface of the heating film 16 in the heating pressure contact portion N2. Therefore, the heating film 16 is driven to rotate in the arrow direction with the fixing roller 30 while the inner peripheral surface of the heating film 16 is sliding against the outer surface of the protective layer 15C of the heater 15.

The control unit 101 turns a triac 20 on in accordance with the image formation sequence. The triac 20 controls power applied from an AC power supply 21 as a first power supply unit, and starts power supply to the heat generating resistive element 15B of the heater 15 via the thermal fuse 40 and the thermal fuse 41. The heat generating resistive element 15B generates heat when power is supplied. The temperature of the heater 15 rises rapidly to heat the heating film 16. The temperature of the heater 15 is detected by a thermistor 18 as a temperature detection unit provided on the surface of the substrate 15A on the side of heating film guide 19. The control unit 101 takes in an output signal (a temperature detection signal) from the thermistor 18 via an A/D conversion circuit 22, and controls the triac 20 so that the detected temperature of the thermistor 18 is kept at a predetermined target temperature based on the output signal.

In the heating pressure contact portion N2, the surface of the fixing roller 30 is heated while rotating with the heat of the heater 15 supplied via the heating film 16. Heat quantity supplied to the surface of the fixing roller 30 via the heating film 16 from the heater 15 is sufficient heat quantity necessary to fix the unfixed toner image T born on the recording material P. In a state in which the driving motor M is driven to rotate and the heater 15 is kept at a target temperature, the recording material P bearing the unfixed toner image T is introduced into the fixing nip portion N1 and is conveyed with the surface on which the toner image is born facing the fixing roller 30. The toner image T is heated and fused in the conveyance process in the fixing nip portion N1 of the recording material P, pressure is applied to the fused toner image T, and the toner image T is fixed to the recording material P.

The target temperature of the heater 15 during the fixing process is determined depending on the thickness, size, and the like of the recording material P. The range of the target temperature in the present embodiment is 120° C. to 250° C. As an example, an operation to fix a recording material P with the temperature of the heater 15 controlled to the target temperature of 250° C. and a temperature profile of each member are described using FIG. 4. At the startup, power is supplied to the heater 15, and the temperatures of the heater 15, the fixing roller 30, and the pressurizing film 51 begin rising from the initial temperature of 23° C. After the temperature of the fixing roller 30 reaches 160° C. which is the fixable temperature, the fixing process starts and the recording material P is introduced in the fixing nip portion N1. While the recording material P is conveyed in the fixing nip portion N1, supply power to the heater 15 is controlled so that the temperature of the heater 15 is kept at 250° C. After the recording material P passes through the fixing nip portion N1, power shut-off starts. In the power shut-off, power supply to the heater 15 is stopped and the temperatures of the heater 15, the fixing roller 30, and the pressurizing film 51 decrease. In the example described above, the highest temperature of the heater 15 is 250° C., the fixing roller 30 is 160° C., and the pressurizing film 51 is 100° C., respectively. During normal use, temperatures of these members can be still higher. For example, the temperature of the heater 15 can exceed the target temperature due to, for example, transient overshoot. Since the power is controlled so that the temperature of the heater 15 becomes the target temperature, the temperature of the fixing roller 30 and the pressurizing film 51 may vary under the influence of the thickness of the recording material P, the ambient temperature, the air flow, and the like. As a result, the highest temperature of each member during normal use of the fixing apparatus of the present embodiment is the heater 15: 270° C., the fixing roller 30: 200° C., and the pressurizing film 51: 140° C. The operating temperatures of the thermal fuse 40 and the thermal fuse 41 are set to be higher than the highest temperature of the heater 15 and the pressurizing film 51 during normal use, respectively. Therefore, operations of the thermal fuse 40 and the thermal fuse 41 during normal use and shutting down of the power supply to the heater 15 are prevented.

(3) Abnormal Temperature Runaway

An operation of a safeguard upon occurrence of an abnormal temperature runaway of the fixing apparatus is described. An abnormal temperature runaway is a status in which power is supplied to the heater 15 with the temperature of the heater 15 exceeding an assumed temperature during normal use due to, for example, a failure. As a safeguard for abnormal temperature runaway, the thermal fuse 40 is provided near the heater 15. Upon occurrence of an abnormal temperature runaway, the temperature of the thermal fuse 40 reaches the operating temperature and the thermal fuse 40 operates to shut down the power supply to the heater 15, whereby damage to the heating unit 10 and the fixing roller 30 is reduced.

Figure 5:
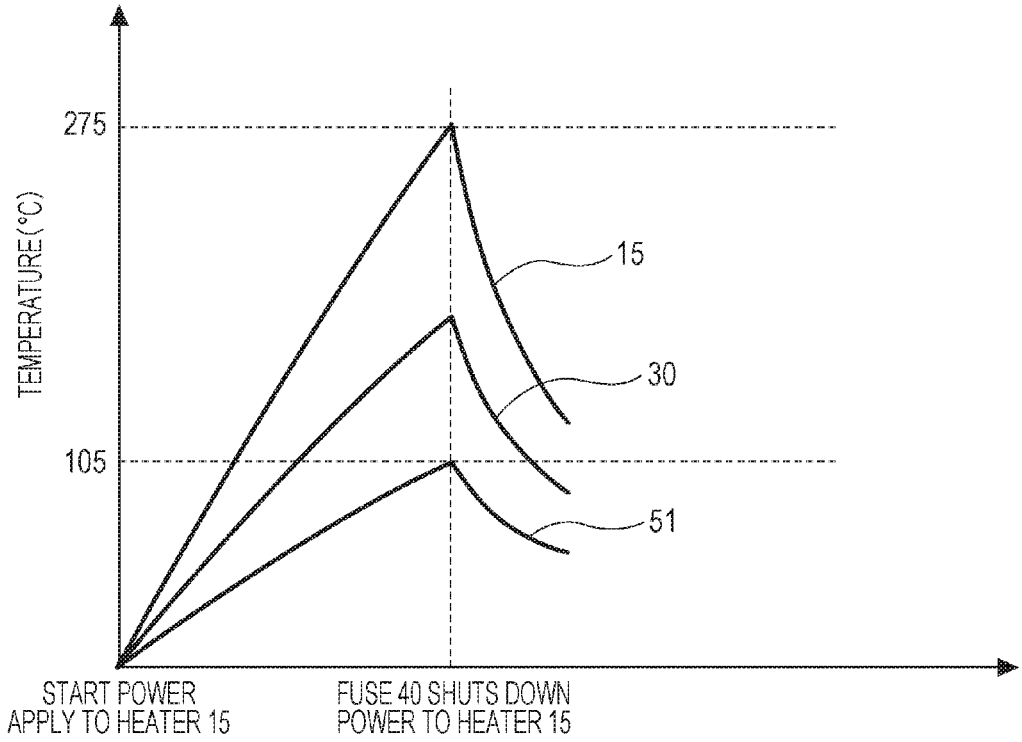
FIG. 5 illustrates temperature transition of the heater, the fixing roller, and the pressurizing film of the fixing apparatus upon occurrence of an abnormal temperature runaway according to the first embodiment.

In the present embodiment, a case in which the fixing roller 30 is driven to rotate in a state in which no recording material P is conveyed in the fixing nip portion N1 due to, for example, a failure, and power is supplied to the heater 15 irrespective of the detected temperature of the thermistor 18 is described. A temperature rise profile of each member in this case is illustrated in FIG. 5. As illustrated in FIG. 5, since heat of the pressurizing unit 50 is not taken by the recording material P, the temperature of the heater 15 can exceed 270° C. which is the highest temperature during normal use. Then, when the temperature of the heater 15 reaches 275° C. (a second threshold temperature) which is the operating temperature of the fuse 40, the fuse 40 operates and the power supply to the heater 15 is shut down. As a result, neither the heating unit 10 nor the fixing roller 30 is damaged. Since the range of target temperatures of the thermistor 18 is 120° C. to 250° C., the second threshold temperature is set to be higher than the target temperature.

As described above, since the operating temperature of the thermal fuse 40 is set to be 275° C., the thermal fuse 40 operates upon occurrence of an abnormal temperature runaway to reduce damage to the heating unit 10 and the fixing roller 30 whereas power application to the heater 15 during normal use is not shut down.

(4) Damage to Pressurizing Film 51 Upon Occurrence of Normal Temperature Runaway Next, an operation of the safeguard upon occurrence of a normal temperature runaway of the fixing apparatus is described. A normal temperature runaway is a status in which the temperature of the heater 15 is controlled within an assumed temperature during normal use, whereas a state in which no recording material P is conveyed in the fixing nip portion N1 is continued and the temperature of the pressurizing unit 50 exceeds the temperature during normal use.

Figure 6A:
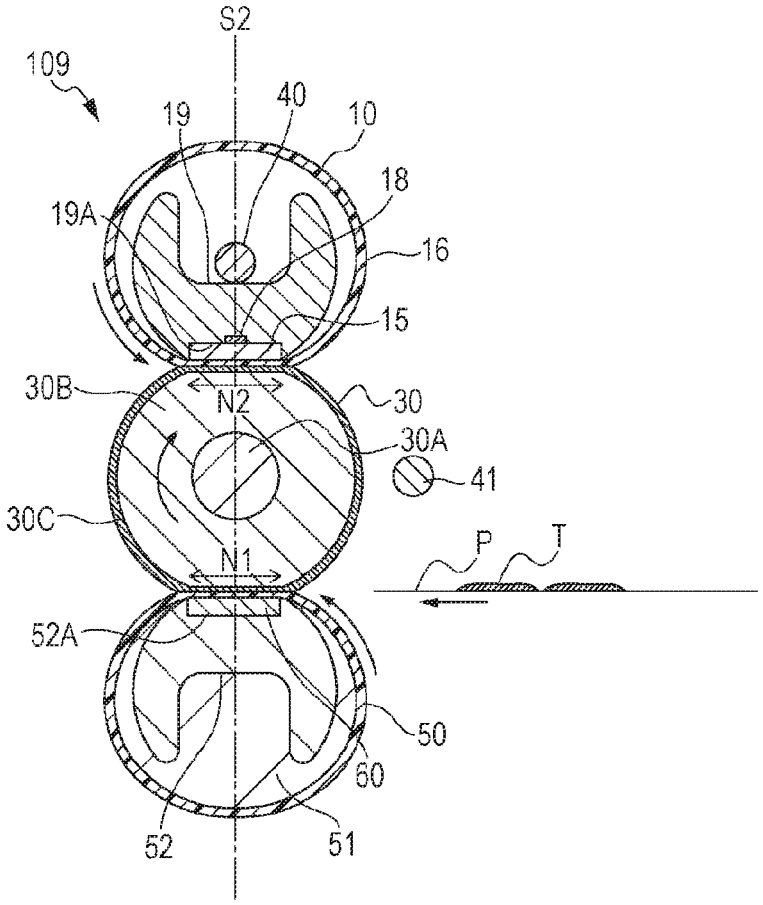
FIG. 6A is a cross-sectional view schematically illustrating a structure of the fixing apparatus in the width direction according to Comparative Example.
Figure 6B:
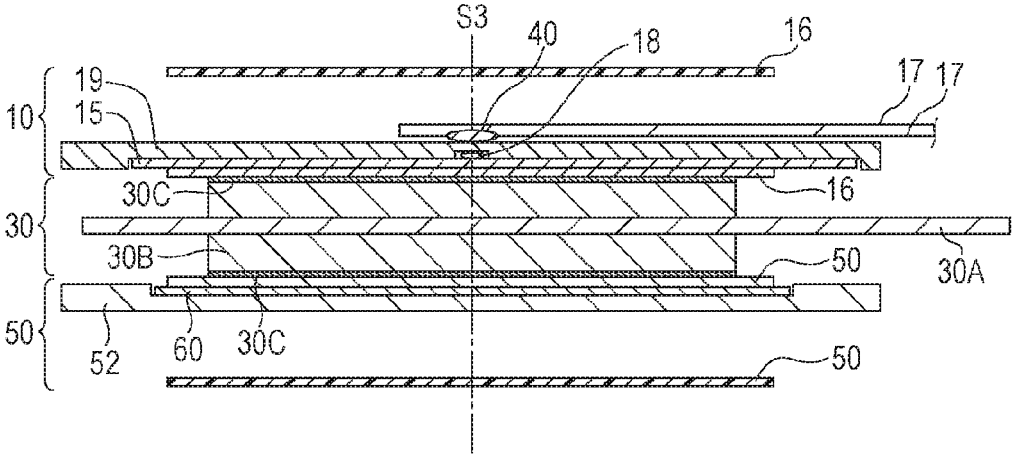
FIG. 6B is a cross-sectional view schematically illustrating a structure of the fixing apparatus in the longitudinal direction according to Comparative Example.

Here, damage to the pressurizing film 51 upon occurrence of a normal temperature runaway in the external heating fixing apparatus is described with reference to Comparative Example of FIGS. 6A and 6B. The fixing apparatus of Comparative Example is the same as the present embodiment in configuration except that the thermal fuse 41 which is the first power shutdown member is disposed in a non-contact manner near the surface of the fixing roller 30, and that the operating temperature of the thermal fuse 41 is set to be 201° C.

Figure 7:
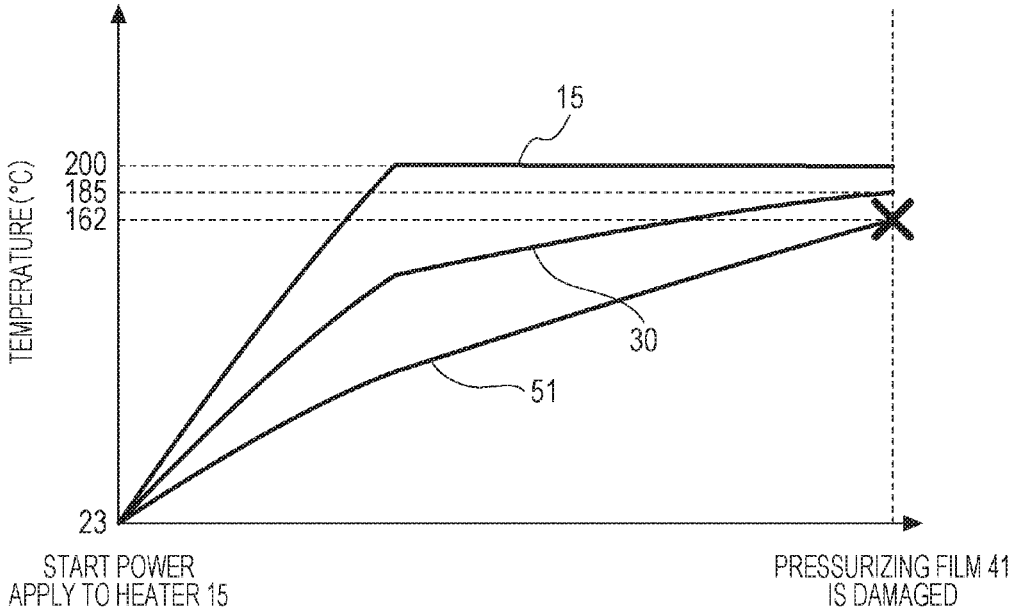
FIG. 7 illustrates temperature transition of a heater, a fixing roller, and a pressurizing film of the fixing apparatus upon occurrence of a normal temperature runaway according to Comparative Example.

The operating temperature of the thermal fuse 41 is set so that sensitivity of abnormality detection becomes the highest in the range in which the thermal fuse 41 does not operate at the highest temperature of 200° C. during normal use of the fixing roller 30. In Comparative Example, a case in which the fixing roller 30 is driven to rotate in a state in which no recording material P is conveyed in the fixing nip portion N1 due to, for example, a failure, and power is supplied to the heater 15 so that the thermistor 18 is kept at 200° C. is described. A temperature rise profile of each member in this case is illustrated in FIG. 7. Since heat of the pressurizing unit 50 is not taken by the recording material P, the temperature of the pressurizing unit 50 easily exceeds the temperature during normal use (when the recording material is conveyed by the nip portion for the fixing process).

However, since the temperature of the heater 15 does not reach 275° C. (the second threshold temperature) which is the operating temperature of the thermal fuse 40, the thermal fuse 40 provided in the heating unit 10 does not operate. Since the temperature of the fixing roller 30 does not reach 201° C. which is the operating temperature of the thermal fuse 41, the thermal fuse 41 does not operate, either. Therefore, the temperature of the pressurizing film 51 continuously rises to reach 162° C., at which the cylindrical shape is no more maintained. Then the pressurizing film 51 is damaged. Especially since the pressurizing film 51 used in the embodiments and Comparative Example is formed by thermoplastic resin, if the temperature of the pressurizing film 51 rises exceeding near the glass transition point Tg, an elastic modulus of the pressurizing film 51 decreases rapidly and the pressurizing film 51 is easily damaged. Since the glass transition point Tg of the thermoplastic resin is lower than that of thermosetting resin, the pressurizing film 51 formed by thermoplastic resin is considered to be easily damaged.

In a configuration in which the thermal fuse 41 is provided near the fixing roller 30 as in Comparative Example, it is difficult to operate the thermal fuse 41 before the pressurizing film 51 is damaged upon occurrence of a normal temperature runaway. The reason is as follows. Although the temperature of the heater 15 of the heating unit 10 is controlled to be kept at the target temperature (200° C.), the temperature of the surface of the fixing roller 30 is not controlled directly. Therefore, the operating temperature of the thermal fuse 41 needs to be set higher so that the thermal fuse 41 does not operate during normal use in consideration of variation in the surface temperature of the fixing roller 30. This is because since the thermal fuse 41 exchanges heat indirectly with the pressurizing film 51 via the fixing roller 30, the temperature of the pressurizing film 51 is hard to be reflected on the thermal fuse 40.

(5) Damage Control of Pressurizing Film 51 of Present Embodiment

Figure 8:
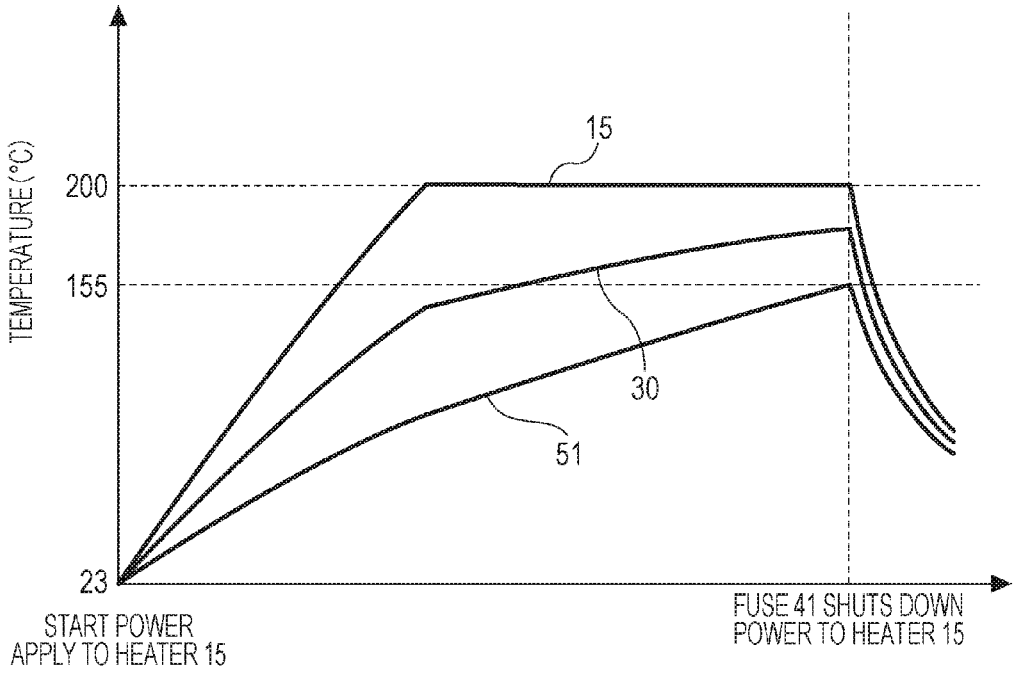
FIG. 8 illustrates temperature transition of a heater, a fixing roller, and a pressurizing film of the fixing apparatus upon occurrence of a normal temperature runaway according to the first embodiment.

Next, a damage control mechanism of the pressurizing unit 50 in the present embodiment is described with reference to FIGS. 1A and 1B. The fixing apparatus of the present embodiment is characterized in that the thermal fuse 41 is provided near the pressurizing unit 50. Specifically, the thermal fuse 41 is provided to face the surface of the pressurizing film 51 in a non-contact manner as illustrated in FIGS. 1A and 1B. In the present embodiment, a case of normal temperature runaway in which the fixing roller 30 is driven to rotate in a state in which no recording material P is conveyed in the fixing nip portion N1 due to, for example, a failure, and power is supplied to the heater 15 so that the thermistor 18 is kept at 200° C. is described. A temperature rise profile of each member upon occurrence of a normal temperature runaway is illustrated in FIG. 8. In the present embodiment, even if the operating temperature of the thermal fuse 41 is set to 155° C. (the first threshold temperature) so that the thermal fuse 41 operates before the pressurizing film 51 reaches the glass transition point Tg, the thermal fuse 41 does not operate during normal use in which the recording material P is conveyed in the fixing nip portion N1. Therefore, without malfunctioning during normal use, the thermal fuse 41 may be operated before the pressurizing film 51 is damaged upon occurrence of a normal temperature runaway.

Although damage to the pressurizing film 51 in the pressurizing unit 50 is described in the present embodiment, the present embodiment also has a damage control effect on members other than the pressurizing film 51.

As described above, according to the present embodiment, damage to the pressurizing unit 50 upon occurrence of a normal temperature runaway may be reduced.

Second Embodiment

Figure 9A:
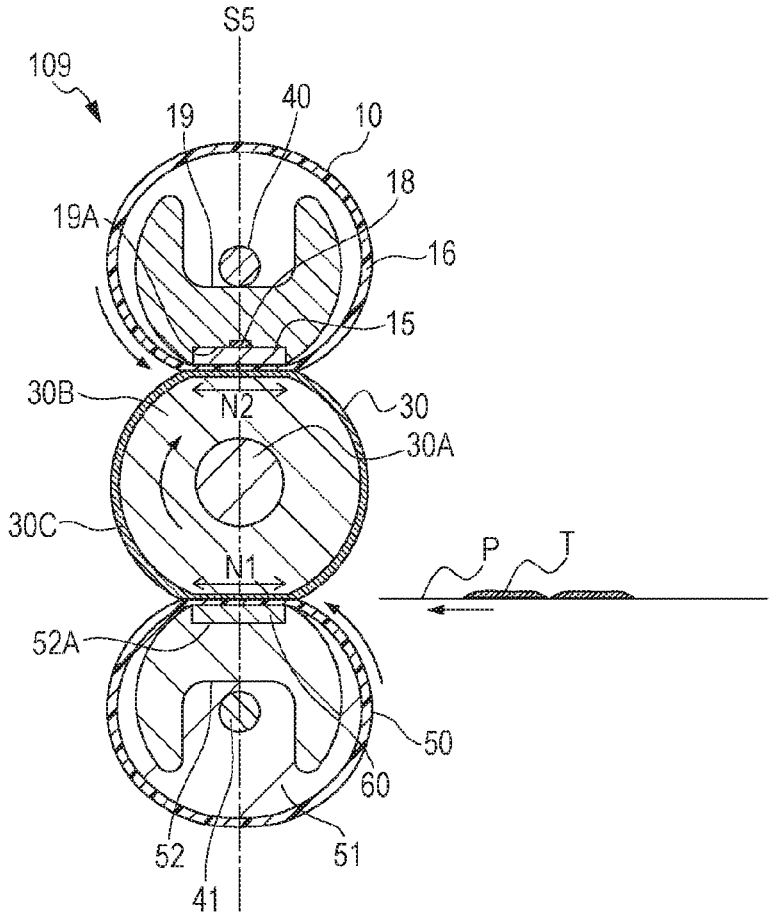
FIG. 9A is a cross-sectional view schematically illustrating a structure of a fixing apparatus in the width direction according to the second embodiment.
Figure 9B:
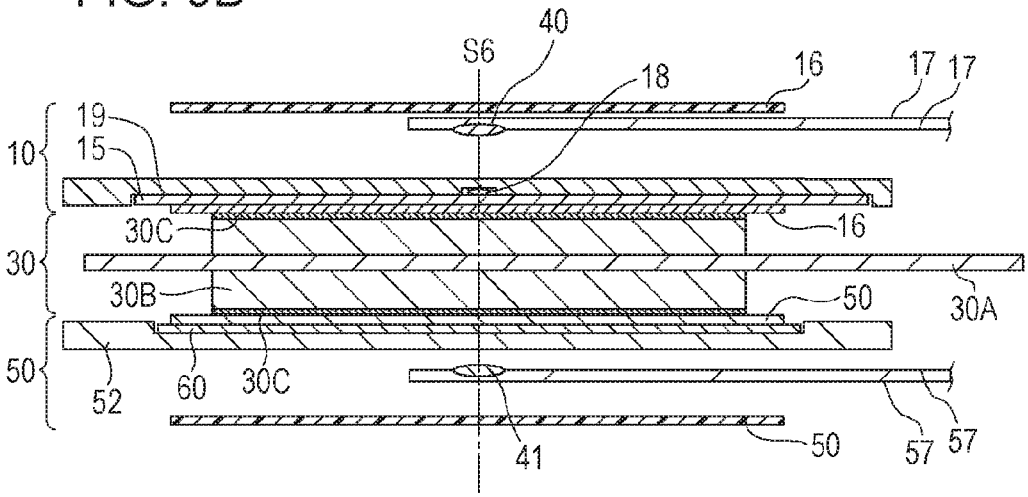
FIG. 9B is a cross-sectional view schematically illustrating a structure of the fixing apparatus in the longitudinal direction according to the second embodiment.

A fixing apparatus according to a second embodiment is described with reference to FIGS. 9A and 9B. FIG. 9A is a cross-sectional view schematically illustrating a structure of the fixing apparatus in the width direction according to the second embodiment. FIG. 9B is a cross-sectional view schematically illustrating a structure of the fixing apparatus in the longitudinal direction according to the second embodiment. FIG. 9A is a cross-sectional view along a dash-dot line s6 of FIG. 9B, and FIG. 9B is a cross-sectional view along a dash-dot line S5 of FIG. 9A.

The thermal fuse 41 as the first power shutdown member is disposed outside the pressurizing unit 50 in the first embodiment, whereas the thermal fuse 41 is disposed inside the pressurizing unit 50 in the present embodiment. The present embodiment is the same as the first embodiment in configuration except for the position of the thermal fuse 41. The same configurations are denoted by the same reference numerals and are not described.

The thermal fuse 41 is provided inside the pressurizing unit 50. The thermal fuse 41 is drawn in the pressurizing film 51 by the wire 57. The thermal fuse 41 is provided on the surface of the pressurizing film guide 52 in a non-contact manner with the pressurizing film 51 and the pressurizing film guide 52 on the side opposite to the side on which the nip portion forming member 60 is provided.

The thermal fuse 41 and the pressurizing film 51, or the thermal fuse 41 and the pressurizing film guide 52 do not necessarily have to be in a non-contact relationship, respectively, and the thermal fuse 41 may be provided anywhere inside the pressurizing film 51. Warm-up time of the fixing apparatus may be shortened by setting the thermal fuse 41 and the pressurizing film 51 non-contact as in the present embodiment. This is because if the thermal fuse 41 and the pressurizing film guide 52 are in contact with each other, heat capacity as the pressurizing unit 50 becomes larger and warm-up time is required accordingly.

Also in the present embodiment, a test in a normal temperature runaway in which the fixing roller 30 is driven to rotate in a state in which no recording material P is conveyed in the fixing nip portion N1 due to, for example, a failure, and power is applied to the heater 15 so that the detected temperature of the thermistor 18 is kept at 200° C. is performed. As a result, the thermal fuse 41 operates before the pressurizing film 51 is damaged, whereby damage to the pressurizing unit 50 is reduced.

The present embodiment has the following advantages by providing the thermal fuse 41 inside the pressurizing unit 50. Since the thermal fuse 41 is less easily affected by the ambient temperature, air flow, and the like outside the pressurizing unit 50, the thermal fuse 41 may be operated while more precisely reflecting the temperature of the pressurizing unit 50. Further, since the thermal fuse 41 is not easily soiled by the debris of the recording material P or the toner image T, the thermal fuse 41 may be operated while more precisely reflecting the temperature of the pressurizing unit 50. When the recording material P is conveyed in the fixing nip portion N1, the debris of the recording material P and the toner image T can be separated from the recording material P and float inside the fixing apparatus. The amount of these floating debris of the recording material P and the toner image T tends to be large at a position closer to the recording material P which is the source of these debris and the toner image T. Therefore, the thermal fuse 41 is less easily soiled by the debris of the recording material P and the toner image T inside the pressurizing unit 50 than outside the pressurizing unit 50.

As described above, according to the present embodiment, damage to the pressurizing unit 50 may be reduced even upon occurrence of a normal temperature runaway.

Third Embodiment

In the first and the second embodiments, the thermal fuse 41 (the first power shutdown member) in the pressurizing unit 50 is provided on the AC circuit on which the heater 15 and the AC power supply 21 which supplies power to the heater 15 are provided (see FIG. 3). In the present embodiment, the thermal fuse 41 is provided on a DC circuit on which a DC power supply 25 as a second power supply unit, and a magnet coil 610 which drives a relay 61 disposed between the heater 15 and the AC power supply 21 are provided. Since the present embodiment is the same as the second embodiment except for the configuration of the power control system, the same configurations are denoted by the same reference numerals and are not described.

Figure 10:
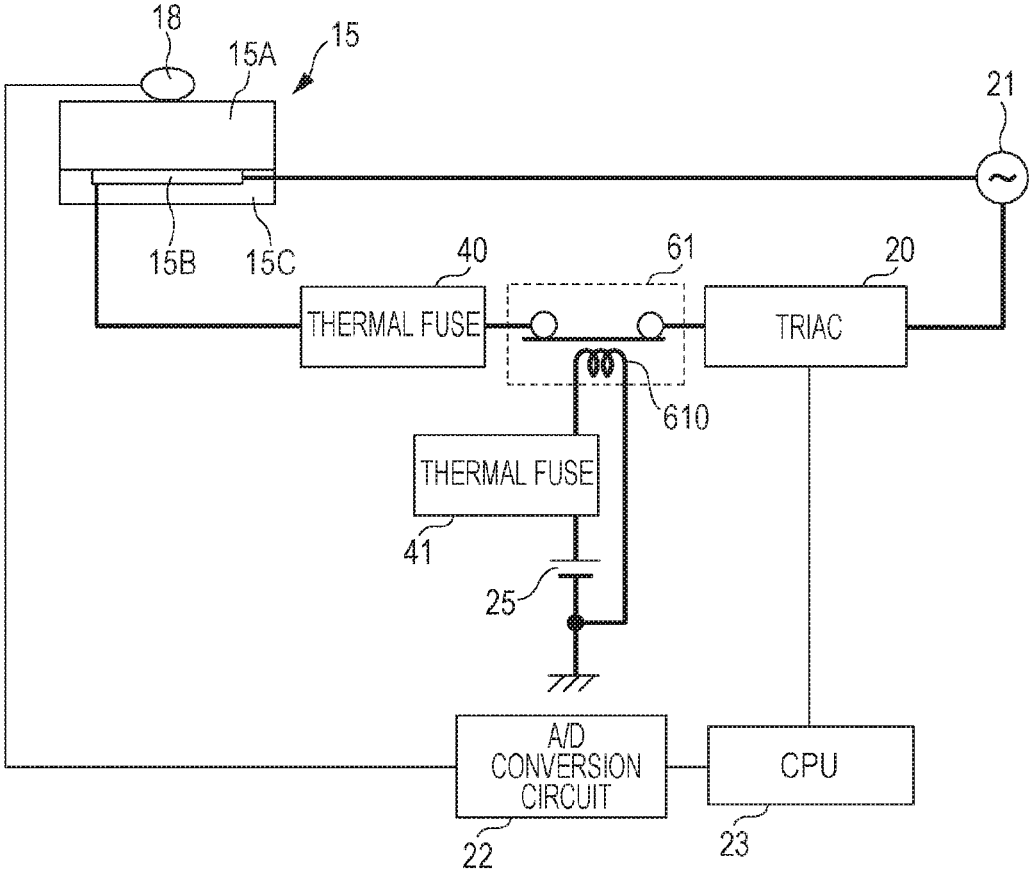
FIG. 10 is an explanatory view illustrating a power control system of a fixing apparatus according to the third embodiment.

A configuration of the power control system of the present embodiment is described with reference to FIG. 10. In the present embodiment, power is supplied to the heater 15 from the AC power supply 21, and the triac 20, the thermal fuse 40 (the second power shutdown member) in the heating unit 10, and the relay 61 are provided on the AC circuit. Power is supplied to the thermal fuse 41 from the DC power supply 25. When the thermal fuse 41 operates, electrical connection of the relay 61 is shut down. That is, during normal use, the relay 61 is electrically conducted and power supply to the heater 15 is not stopped, whereas when 155° C. which is the operating temperature of the thermal fuse 41 is reached, the power supply to the heater 15 is physically shut down by the relay 61.

A test in a normal temperature runaway is performed using the fixing apparatus of the present embodiment. As a result, the thermal fuse 41 is operated before the pressurizing film 51 is damaged, power supply to the heater 15 is shut down, whereby damage to the pressurizing unit 50 is reduced.

A further effect of the present embodiment is described. Since the voltage of the DC power supply 25 which supplies power to the thermal fuse 41 is small, the current flowing in the thermal fuse 41 is smaller than that of the first embodiment. Therefore, since the thermal fuse 41 is hardly affected by a self temperature rise, the thermal fuse 41 may be operated while more precisely reflecting the temperature of the pressurizing unit 50.

Since the current flowing in the thermal fuse 41 in the present embodiment is smaller than that of the first and the second embodiments, the diameter of the wire 57 of the thermal fuse 41 may be reduced. As a result, there is an effect that the size of the fixing apparatus may be reduced. This effect is especially large in the external heating fixing apparatus. In the first and the second embodiments, the heating unit 10 and the pressurizing unit 50 are provided separately via the fixing roller 30. Therefore, the fixing apparatus may become larger in size because the thermal fuse 40 in the heating unit 10 and the thermal fuse 41 in the pressurizing unit 50 need to be connected using a thick wire.

As described above, according to the present embodiment, damage to the pressurizing unit 50 may be reduced also upon occurrence of a normal temperature runaway.

Although the thermal fuse 40 in the heating unit 10 is provided on the AC circuit on which the heater 15 and the AC power supply 21 are provided in the present embodiment, the thermal fuse 40 may alternatively be provided on a DC circuit that drives a relay to shut down the power supply to the heater 15. A configuration in which the thermal fuse 40 and the thermal fuse 41 are used is described in the present embodiment. However, the present invention is not limited to the same and other power shutdown members, such as a thermoswitch and a thermostat, may be employed instead of the thermal fuse.

Fourth Embodiment

In the first embodiment, the thermal fuse 41 is provided on the AC circuit on which the heater 15 and the AC power supply 21 are provided (see FIG. 3). In the present embodiment, a power supply stop unit including a thermistor 43, a protection circuit 63, and a relay 62 is used instead of the thermal fuse 41. Since the present embodiment is the same as the second embodiment except for the configuration of the power control system, the same configurations are denoted by the same reference numerals and are not described.

Figure 11:
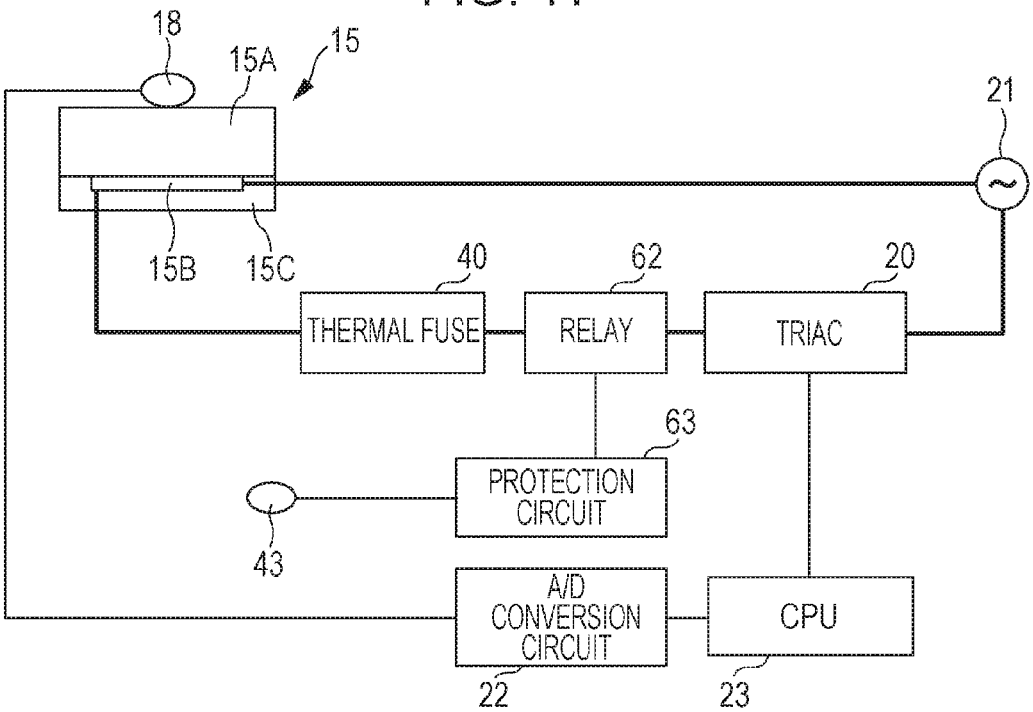
FIG. 11 is an explanatory view illustrating a power control system of a fixing apparatus according to the fourth embodiment.

A configuration of the power control system of the present embodiment is described with reference to FIG. 11. In the pressurizing unit 50, the thermistor 43 is provided at the same position as that the thermal fuse 41 is disposed in the pressurizing unit 50 of the first embodiment. The protection circuit 63 is an analog circuit using a comparator and the like, which shuts down the relay 62 provided between the AC power supply 21 and the heater 15 when a detected temperature input by the thermistor 43 exceeds a predetermined temperature (155° C.). Then, as in the case of the first embodiment, power supply to the heater 15 may be shut down before the pressurizing film 51 is damaged upon occurrence of a normal temperature runaway.

As described above, according to the present embodiment, an abnormal temperature of the pressurizing film 51 may be detected upon occurrence of a normal temperature runaway, and damage to the pressurizing unit 50 may be reduced. As a modification of the present embodiment, a configuration in which no thermal fuse 40 of the heating unit 10 is provided is described.

Figure 12:
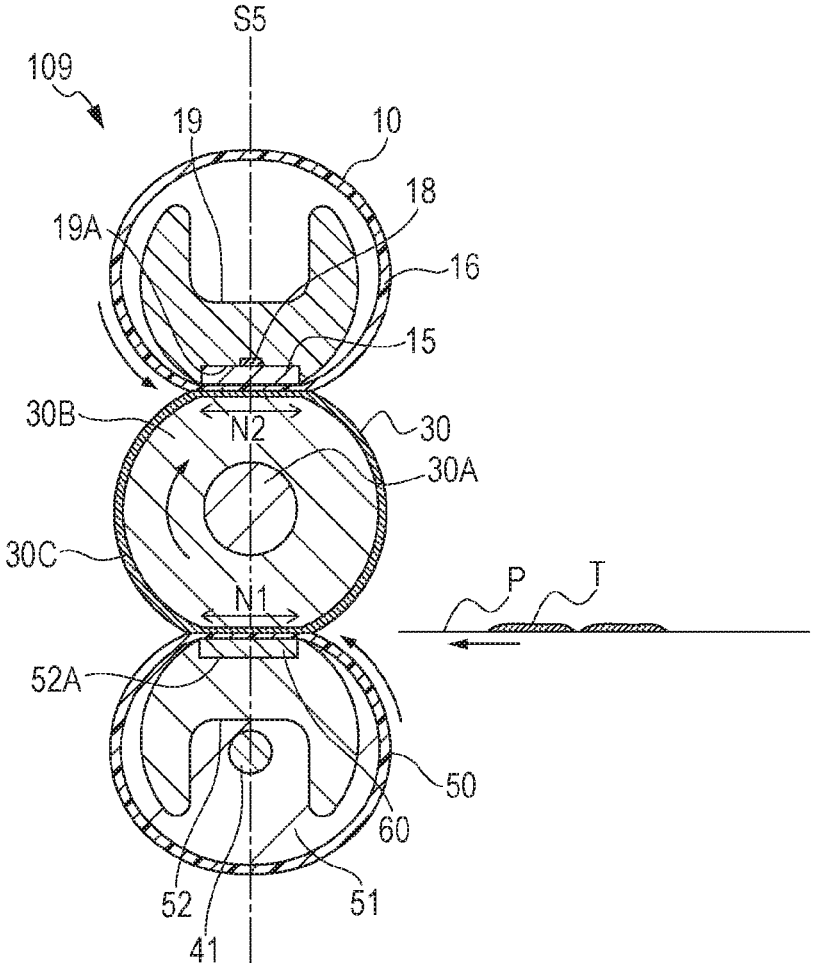
FIG. 12 is a cross-sectional view schematically illustrating a structure of a fixing apparatus in the width direction according to the fourth embodiment.
Figure 13:
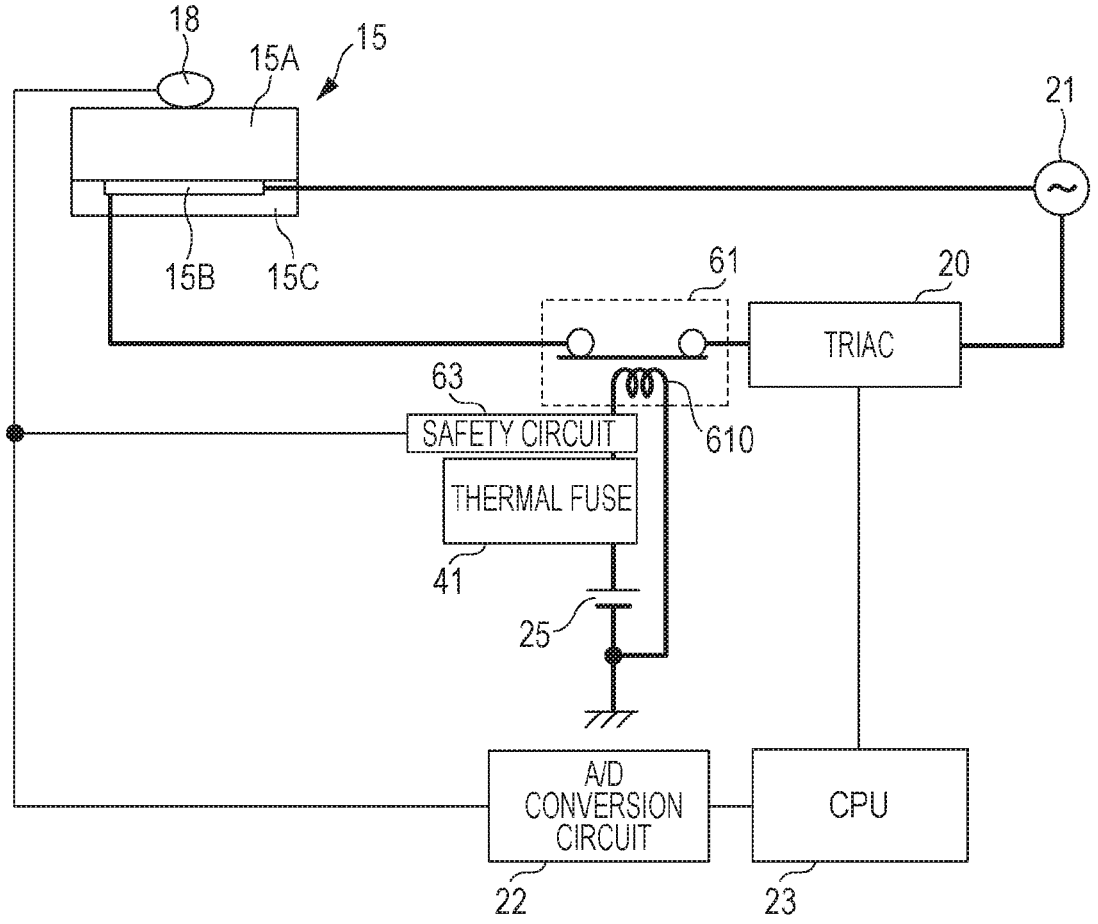
FIG. 13 is an explanatory view illustrating a power control system of the fixing apparatus according to a modification of the fourth embodiment.

FIG. 12 is a cross-sectional view of a fixing apparatus of the modification and FIG. 13 illustrates a power control system. In the present embodiment, the thermal fuse 41 is provided in the pressurizing unit 50. The power control system of the thermal fuse 41 is the same in configuration as that of the third embodiment in which the thermal fuse 41 is provided on the DC circuit. The heating unit 10 has no thermal fuse but is provided with the thermistor 18 which detects the temperature of the heater 15. In this modification, as illustrated in FIG. 13, a safety circuit (a separator) 63 is provided on the DC circuit in which the thermal fuse 41 of the pressurizing unit 50 is provided. In the safety circuit 63, the detected temperature by the thermistor 18 and the predetermined temperature (275° C.) are compared. If the detected temperature by the thermistor 18 exceeds the predetermined temperature, the relay 61 is driven by the magnet coil 610 and the power supply to the heater 15 is shut down. In this modification, a safeguard having the thermistor 18, the safety circuit 63, the magnet coil 610, and the relay 61 is provided in the pressurizing unit 50. In the configuration of this modification, the thermistor 18 is added not for the safeguard but for the power supply to the heater 15. Therefore, there is an advantage that an existing configuration is used. Alternatively, a thermistor dedicated for the safeguard may be provided separately from the thermistor 18.

As described above, also according to this modification, damage to the pressurizing unit 50 upon occurrence of a normal temperature runaway may be reduced.

In any of the present embodiment, the modification thereof, and the first to the third embodiments, the heating unit 10 is not limited to that having a configuration in which the heater is in contact with the inner surface of the film. Alternatively, for example, the heating film 16 is not provided and the heater 15 may be in direct contact with the fixing roller 30 to form the pressure contact portion N2. Further, for example, a halogen heater and the like may be provided in the heating unit 10 instead of the heater 15. The heating film 16 itself may generate heat when power is applied directly thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110381, filed May 29, 2015, which is hereby incorporated by reference herein in its entirety.

What is claimed is:

1. A fixing apparatus for fixing a toner image on a recording material while conveying the recording material on which the toner image has been formed at a nip portion, comprising:

a roller;

a heating unit configured to heat the roller from outside the roller, the heating unit receiving power supplied from a power supply;

a backup unit forming the nip portion with the roller; and a power shutdown member configured to operate in response to an abnormal temperature of the backup unit and shut down power supply to the heating unit.

2. The fixing apparatus according to claim 1, further comprising: a temperature detection unit configured to detect a temperature of the heating unit, wherein, when a detected temperature by the temperature detection unit reaches a predetermined temperature, power being supplied to the heating unit is shut down.

3. The fixing apparatus according to claim 2, further comprising: a control unit configured to control power supplied to the heating unit so that the detected temperature by the temperature detection unit becomes a target temperature, wherein the predetermined temperature is higher than the target temperature.

4. The fixing apparatus according to claim 1, wherein the backup unit includes a cylindrical film and a nip portion forming member which is in contact with an inner surface of the film and forms the nip portion with the roller, and wherein the power shutdown member is disposed in the film.

5. The fixing apparatus according to claim 1, wherein the power shutdown member is a thermal fuse.

6. The fixing apparatus according to claim 2, wherein the heating unit includes a cylindrical film and a heater in contact with an inner surface of the film, and wherein the temperature detection unit is provided on the heater.

7. The fixing apparatus according to claim 4, wherein the film is made of thermoplastic resin.

8. A fixing apparatus for fixing a toner image on a recording material while conveying the recording material on which the toner image has been formed at a nip portion, comprising:

a roller;

a heating unit configured to heat the roller from outside the roller, the heating unit receiving power supplied from a power supply;

a backup unit forming the nip portion with the roller;

a first power shutdown member configured to operate in response to an abnormal temperature of the backup unit and shut down power supply to the heating unit; and a second power shutdown member configured to operate in response to an abnormal temperature of the heating unit and shut down power supply to the heating unit.

9. The fixing apparatus according to claim 8, wherein the first shutdown member is a thermal fuse or a thermoswitch, and the second shutdown member is a temperature detection unit.

10. The fixing apparatus according to claim 8, wherein the backup unit has a cylindrical film formed by thermoplastic resin.

* * * * *